US005171379A

United States Patent [19]

Kumar et al.

[11] Patent Number: 5,171,379

[45] Date of Patent: Dec. 15, 1992

[54] TANTALUM BASE ALLOYS

[75] Inventors: Prabhat Kumar, Allentown; Charles E. Mosheim, Zionsville, both of Pa.

[73] Assignee: Cabot Corporation, Billerica, Mass.

[21] Appl. No.: 701,428

[22] Filed: May 15, 1991

[51] Int. Cl.[5] ..... C22C 27/00

[52] U.S. Cl. ..... 148/422; 420/425; 420/426; 420/427

[58] Field of Search ..... 420/425–426, 420/427; 148/422

[56] References Cited

U.S. PATENT DOCUMENTS

| | | | |
|---|---|---|---|
| 3,268,328 | 8/1966 | Torti | 148/422 |
| 3,497,402 | 2/1970 | Douglass et al. | 148/422 |
| 4,235,629 | 11/1980 | Marsh et al. | 420/427 |
| 4,859,257 | 8/1989 | Bates et al. | 148/422 |
| 4,957,541 | 9/1990 | Tripp et al. | 420/427 |

*Primary Examiner*—Upendra Roy
*Attorney, Agent, or Firm*—David J. Koris

[57] ABSTRACT

A wrought metal alloy product having a tantalum or niobium base metal, 10 to 1000 ppm silicon, and 10 to 10000 ppm yttrium nitride. Fine uniform grain size contributes to improved ductility.

27 Claims, 6 Drawing Sheets

5070-70-10 N-2
1375 200.0KV 100.0cm (400 Si + 100 YN)

(100 $ThO_2$)

(400 Si + 100 $Y_2O_3$)

(400 Si)

(100 YN + 400 Si)

(100 Th $O_2$)

(100 $Y_2O_3$ +400 Si)

(400 Si)

5078-78-6 N-1
1358 200.0KV 100.0cm (400 Si + 100 YN)

(400 Si + 100 $Y_2O_3$)

TANTALUM BASE ALLOYS

BACKGROUND OF THE INVENTION

The present invention pertains to the field of wrought metal base alloy products with improved chemical and physical characteristics, and more particularly to products of tantalum or niobium metal base alloys containing quantities of silicon and a dopant such as yttrium nitride.

Tantalum alloys have been recognized as preferred materials in the field of furnace equipment: such as trays and heating elements, and radiation shielding where the thermal stability of the alloy is maintained and the life span of the product is enhanced by reduced embrittlement. Tantalum alloys have also been employed in the manufacture of wire and more particularly as electric component leads where product characteristics such as ductility, high dielectric constant, resistance to grain growth at elevated temperatures, and improved processability are required. In the production of capacitors, for example, the lead wires may either be pressed into the tantalum powder anode and subsequently sintered at high temperatures, or spot welded to sintered capacitor bodies. See U.S. Pat. No. 3,986,869.

In both electrical component and furnace equipment products, contamination by oxygen contributes to embrittlement and piece failure. For example, in wire products, the area where a lead wire leaves an anode body is highly susceptible to embrittlement due to migration of oxygen from the sintered body to the wire. Lead wires which become embrittled or break results in the loss of the entire piece. Substantial economic benefit can be gained from a tantalum or niobium base alloy which does not lose strength or ductility due to embrittlement after exposure to high temperatures.

For purposes of simplicity, reference hereafter will be made solely to tantalum even though it is understood that niobium is also contemplated. The chemical similiarities between the two elements are well known to those skilled in the art.

The term "ductility" is typically understood to mean a percentage increase in length of the metal prior to failure in a tensile test.

The term "bend-ductility" is a physical characteristic synonymous with reduced embrittlement or ability to withstand repetitive bending. The term is typically represented as a number of successful bends in an anode after single or double sintering in vacuum.

Oxygen embrittlement occurs in tantalum base alloy products by several mechanisms. Tantalum acts as a getter for oxygen in addition to other gaseous impurities present in sintering operations such as carbon monoxide, carbon dioxide, and water vapor. Attempts have been made to reduce tantalum oxide formation by doping tantalum with carbon or a carbonaceous material. Oxygen reacts with the carbon at the surface of the metal rather than diffusing into the tantalum thereby minimizing embrittlement. While enhanced ductility levels may be achieved with carbon addition, the dopant may adversely effect the processability and electrical characteristics of the metal. Carbon particles on the surface of the tantalum may result in increased electrical leakage due to the non-uniform adherence of tantalum oxide film.

The term "dopant" is known to those skilled in the art to mean a trace quantity of material which is normally added to a base material.

The term "processability" is defined here after as the ratio of tensile strength to yield strength. Processability is measured by mechanical evaluation of tantalum alloy by a variety of methods including standardized ASTM testing referenced hereafter.

U.S. Pat. Nos. 4,128,421 and 4,235,629 disclose the addition of silicon and/or carbon to tantalum to increase ductility. Silicon is volatilized in part during processing and therefore must be added in excess in the original master blend.

While it is speculated that silicon functions as a getter similar to carbon, the addition of excess silicon may effect the electrical characteristics of the wire product by the same mechanism described above for carbon or carbonaceous materials.

The doping of tantalum powder with phosphorus is generally disclosed in U.S. Pat. Nos. 3,825,802, 4,009,007, and 4,957,541 as a means for improving the electrostatic capacity of capacitors and flow properties of the tantalum powders. Some significance is attributed to the amount of dopant added in the '007 patent (ranging from 5 to 400 ppm). Although the mechanism by which phosphorous functions as a dopant to tantalum metal is not completely known, one theory is that it reduces the sintering rate of tantalum by decreasing the surface diffusion of tantalum.

Another mechanism for reducing the embrittlement of tantalum base alloy products involves the doping of tantalum powder with yttrium, U.S. Pat. Nos. 3,268,328, 3,497,402; or thoria, U.S. Pat. No. 4,859,257; or oxides therefrom.

U.S. Pat. No. 3,268,328 discloses a yttrium oxide doped tantalum alloy having an average grain size of 4 to 6 (ASTM).

The term "grain-size" may be defined as the number of grains of tantalum as compared with a standard ASTM grain size chart at 100X magnification. The term "fine grain-size" may be defined to mean an ASTM value of greater than ASTM 5 or less than about 55 microns. The term "uniform grain-size" refers to a grain-size which does not vary by more than one ASTM number according to the testing procedure discussed above.

A combination of dopants in a tantalum base alloys for wrought wire applications is disclosed in U.S. Pat. No. 4,859,257. The patent discloses an alloy formed by adding 125 ppm silicon and 400 ppm thoria to tantalum powder. An ASTM grain size No. 10 and No. 5 are obtained for a doped and an undoped control of pure tantalum powder. This translates into a doped tantalum base alloy grain size of 10 microns in comparison to a control of 55 microns. It is maintained that the mechanisms where silicon functions as an oxygen getter and where metal oxide functions as a grain boundary restraint, explain the basis for the reported fine grain size and ductility. The mechanisms, however, suffer from previously discussed problems of product quality due to silicon evaporation and grain growth after exposure to high temperatures due to dispersant particle growth. A tantalum based alloy which provides consistently high ductility and processability after exposure to high temperatures would be a considerable advance in the field of tantalum metallurgy.

Another object of the present invention is to provide tantalum alloy which maintains processability and ductility with low concentrations of dopants.

A further object of the present invention is to provide a doped tantalum alloy which maintains a high level of processability and ductility and wherein the dopants resist coarsening after exposure to high temperatures.

Yet a further object of the present invention is to provide a wrought wire product from tantalum base alloy which maintains processability and ductility, and which minimizes DC electrical leakage.

Accordingly, the present invention alleviates the above mentioned problems and achieves the cited objectives in a wrought metal alloy product comprising a tantalum or niobium base metal, a quantity of silicon between about 10 to about 1000 ppm, and between about 10 to about 1000 ppm of a dopant comprising a metallic and a non-metallic component. The dopant has a Gibbs free energy of formation higher than compounds formed from the tantalum or niobium base metal selected and the non-metallic component of the dopant, and a Gibbs free energy of formation lower than oxides formed of the dopant metal component.

The present invention further comprises in a wrought metal alloy product, the combination of a tantalum or niobium base metal with about 100 to about 500 ppm silicon and about 100 to about 500 ppm yttrium nitride. The product further includes a ductility of about 20% after exposure to elevated temperatures of greater than 1300° C., and exhibits a fine uniform grain size of about 3 to about 30 microns. Low levels of carbon and oxygen impurities are maintained at about 50 and 300 ppm respectively. As discussed below, the inventors have discovered that the unexpected physical and chemical properties of the invention are largely due to the synergistic effect of silicon and yttrium nitride dopants.

A further advantage is that yttrium silicide is more resistant to dispersant particle growth than metal oxides such as yttrium or thoriam oxides.

A further advantage of the present invention is that wrought metal alloy products produced have improved ductility after exposure to elevated temperatures and improved bend ductility.

A further advantage is that excess quantities of dopant formerly needed to replace evaporated silicon are not required. The grouping of excess dopant on the surface of the wrought alloy product and the associated problem of discontinuous tantalum oxide insulating, is also alleviated.

BRIEF DESCRIPTION OF THE DRAWINGS

The disclosed objects, features, and advantages are further illustrated by the drawings, detailed description, and claims presented below:

DETAILED DESCRIPTION OF A PREFERRED EMBODIMENT

Figure 1A:
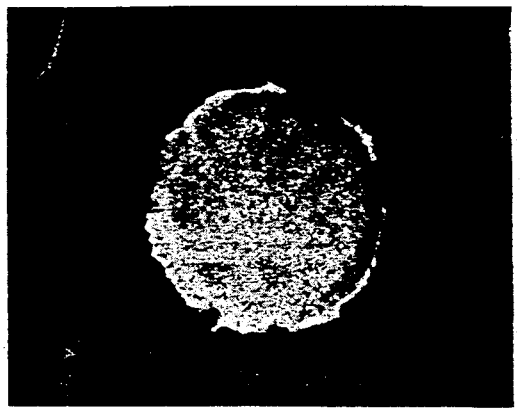
FIG. 1 illustrates the microstructures of tantalum wire made by doping with silicon plus yttrium nitride; thoriam oxide; silicon plus yttrium oxide; and silicon; all after annealing at 1300° C.
Figure 1B:
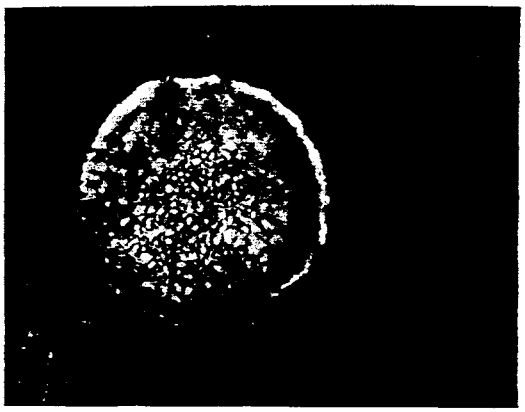
Figure 1C:
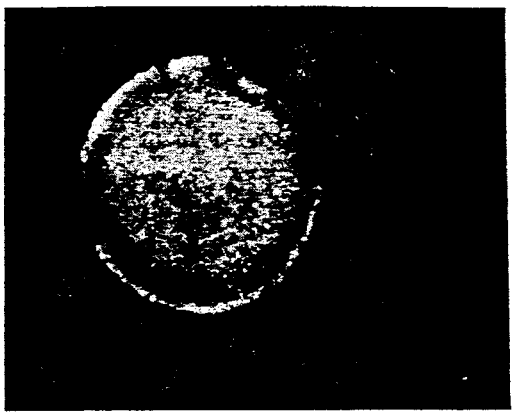
Figure 1D:
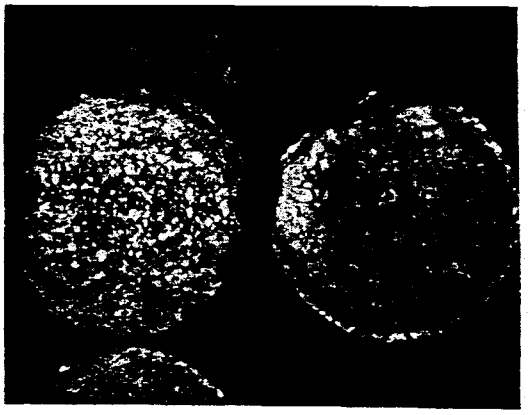

The wrought metal alloy product of the present invention is made generally from a process where tantalum base metal powder is blended with a quantity of silicon between about 10 to about 1000 ppm, and a quantity of dopant between about 10 to about 1000 ppm. The dopant comprising a metallic and a non-metallic component with the metallic portion selected from a group comprising yttrium, thorium, lanthanum, hafnium, titanium and zirconium. The non-metallic component is selected from the group comprising nitrogen, sulfur, selenium, tellurium, arsenic, antimony, carbon, phosphorous, and boron. The dopant is further characterized to include a free energy of formation greater than compounds formed from the base metal and non-metallic component, and less than oxides of said metallic component. For example, the present invention preferably includes the use yttrium nitride which has a Gibbs free energy value of 64.8 (taken as an absolute number) which falls above a low free energy value of tantalum nitride of 52.4 and below a high value of yttrium oxide of 145 kcal/atom. Other dopants, having metallic and non-metallic components falling within the free energy range parameters of the base metal and non-metallic component, and the oxide of the metallic component, are readily ascertainable to those skilled in the art by an examination of the corresponding free energy values of ther compounds selected.

Bars were made by first blending the base metal alloy, silicon, and dopant powders by mechanical means such as a twin cone blender, and then subjecting the powder to cold isostatic pressing at 60,000 PSI. The bars were then placed in a vacuum chamber and sintered by direct resistance sintering at between 2350° to 2400° C. for about 4 hours.

The doped tantalum bar stock may be used to generate a variety of wrought products including furnace trays and leads for electronic components. For the purpose of simplicity, the following description shall pertain primarily to wrought wire products.

Wrought wire was made from the sintered bars by rolling to a 20 mm by 20 mm cross-section followed by annealing. This was accomplished at 1300° C. for two hours in a standard vacuum furnace. The annealed bar was then rolled to a cross-section of 9 mm by 9 mm and reannealed at 1300° C. for two more hours. Further processing was accomplished by drawing through various dies and annealing at 1300° C.

The tantalum powder may be made by several methods including the processes disclosed in U.S. Pat. No. 4,684,399, assigned to the present assignee, Cabot Corporation. The process disclosed in Columns 4, 5 and Examples 2–9 are incorporated by reference herein.

Referring to FIG. 1, photomicrographs were taken of 0.25 mm diameter tantalum wires, made by doping with various dopants and annealing at about 1300° C. for two hours. As illustrated, tantalum wire doped with 100 ppm yttrium oxide and 400 ppm silicon, exhibits incomplete recrystallization. In comparison, the wire made by doping tantalum powder with yttrium nitride and silicon, made according to the procedure of Example 1 below, and illustrated in FIG. 1, exhibits full recrystallization and a uniform fine grain structure. Grain sizes ranging from about 2 to about 55 microns are preferable.

Figure 2:
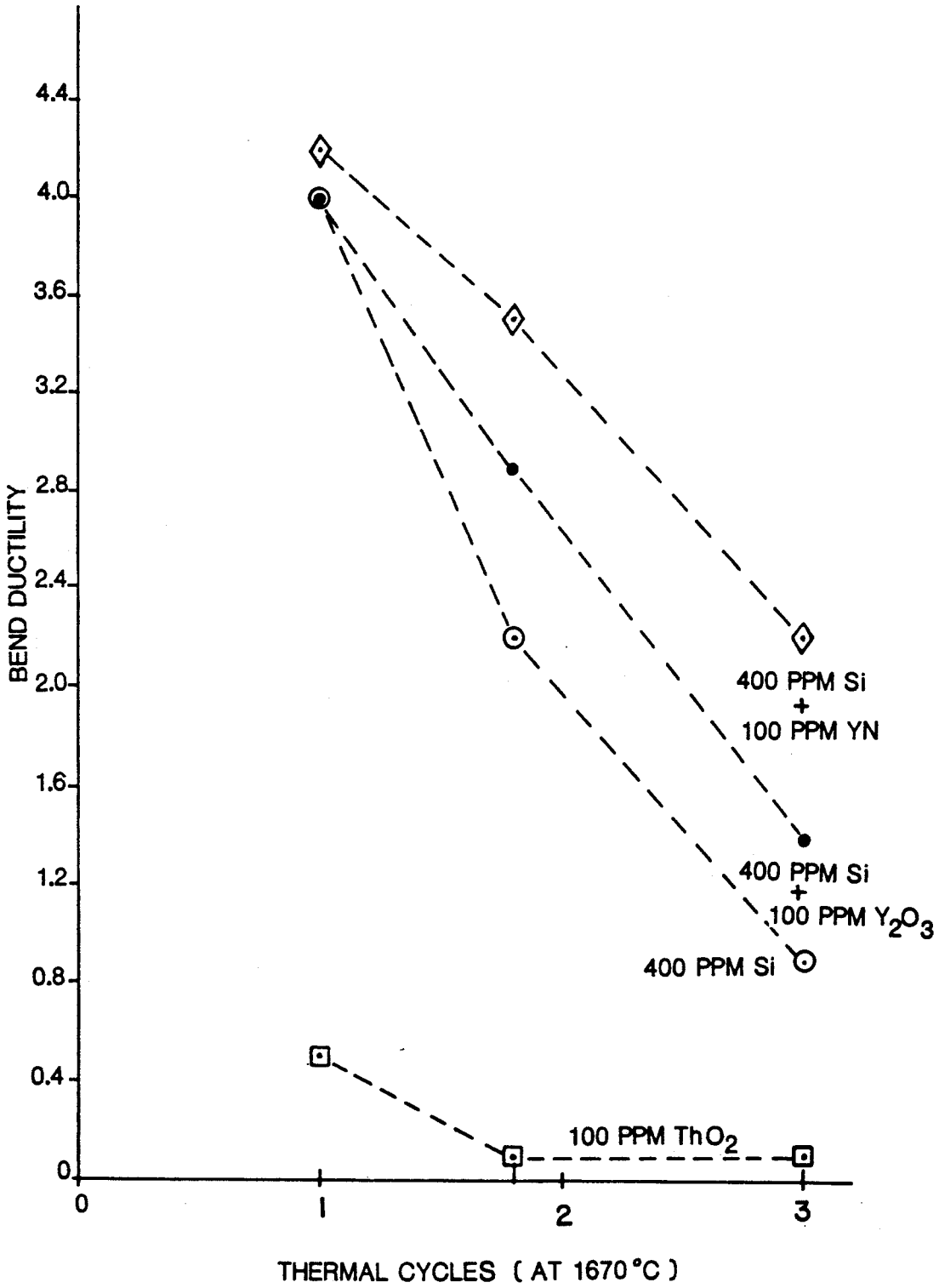
FIG. 2 illustrates a graph of the the bend ductility of the wire compositions illustrated in FIG. 1 after sintering.
Figure 3A:
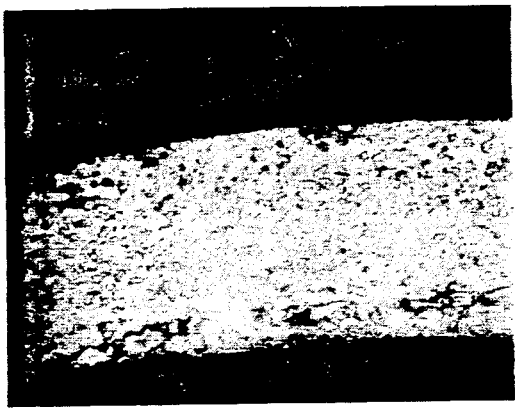
FIG. 3 illustrates microsturctures of 0.38 mm tantalum sheets doped with silicon and yttrium nitride; with thoriam oxide; with silicon plus yttrium oxide; and with silicon; all after annealing at 1800° C.
Figure 3B:
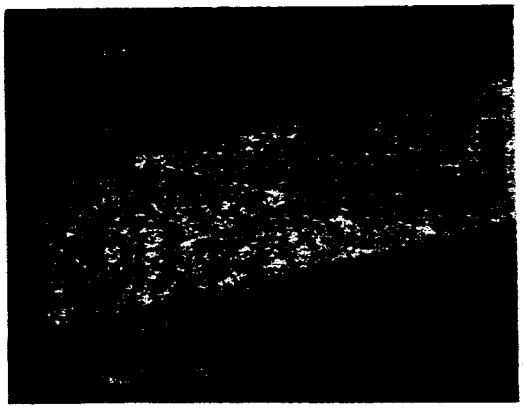
Figure 3C:
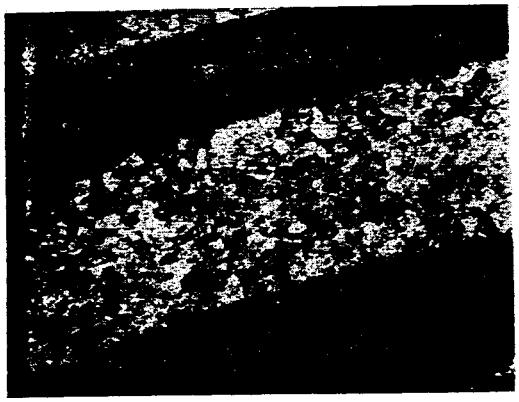
Figure 3D:
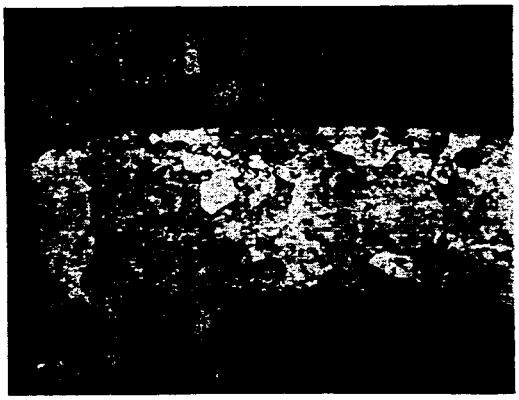

FIG. 2 illustrates improved bend ductility of wire produced by the procedure and materials of Example 1. Bend ductility ranged from 0.1 bends for tantalum doped with thorium oxide, to about 4.2 for tantalum doped with silicon and yttrium nitride after exposure to temperatures of greater than 1500° C.

Referring to FIG. 3, tantalum sheets, made by the procedure of Examples 1 to 4, were subjected to elevated temperatures of 1800° C. In addition to the apparent differences in grain-sizes, a mixture of large and small grains (commonly known as duplex or abnormal grain structure) are visible in the sample where yttrium oxide was used as the dopant. Coalescence of thermodynamically stable oxide particles is known to be responsible for this phenomenon in oxide doped metals and alloys. Although the mechanism is not completely understood, one theory accounting for dopant particle growth or "dispersant coarsening" is that the coarsening occurs due to the high diffusion rate of oxygen and metal atoms of oxides in refractory metals which is driven by the interfacial energy of the dispersoids. Enlarged dispersant particles have lower surface energy and therefore cannot function to restrain grain boundary migration. Grain growth in turn, results in loss of ductility.

Under normal manufacturing temperatures of about 1300° C., metal oxides act to reduce grain growth by pinning the grain boundaries. Metal oxides typically have higher Gibbs free energy and are more stable in comparison with nitrides. Metal oxides, however are generally not stable after being subjected to elevated temperature conditions such as are encountered in furnace environments. One skilled in the art would expect nitrides to form oxides when exposed to oxygen environments at elevated temperatures and exhibit metallurgical properties similiar to oxides. Applicant's have discovered unexpected improved microstructure stability and bend ductility in a wrought base metal alloy product formed from tantalum powder doped with a material having lower Gibbs values (absolute) than that found in oxide dopants.

Figure 4:
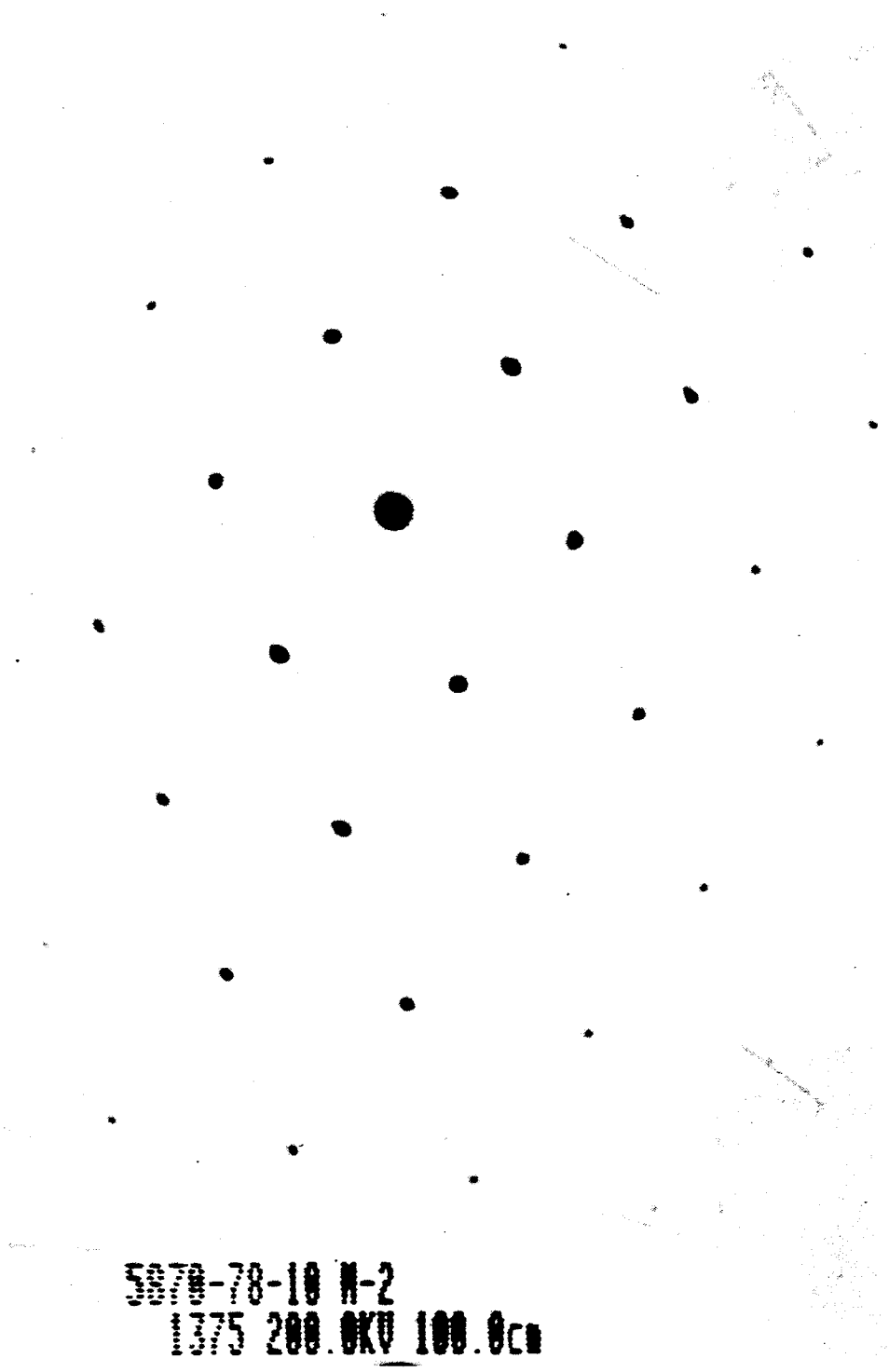
FIG. 4 illustrates an electron diffraction pattern of 0.38 mm tantalum sheet doped with silicon and yttrium nitride after annealing at 1500° C.
Figure 5:
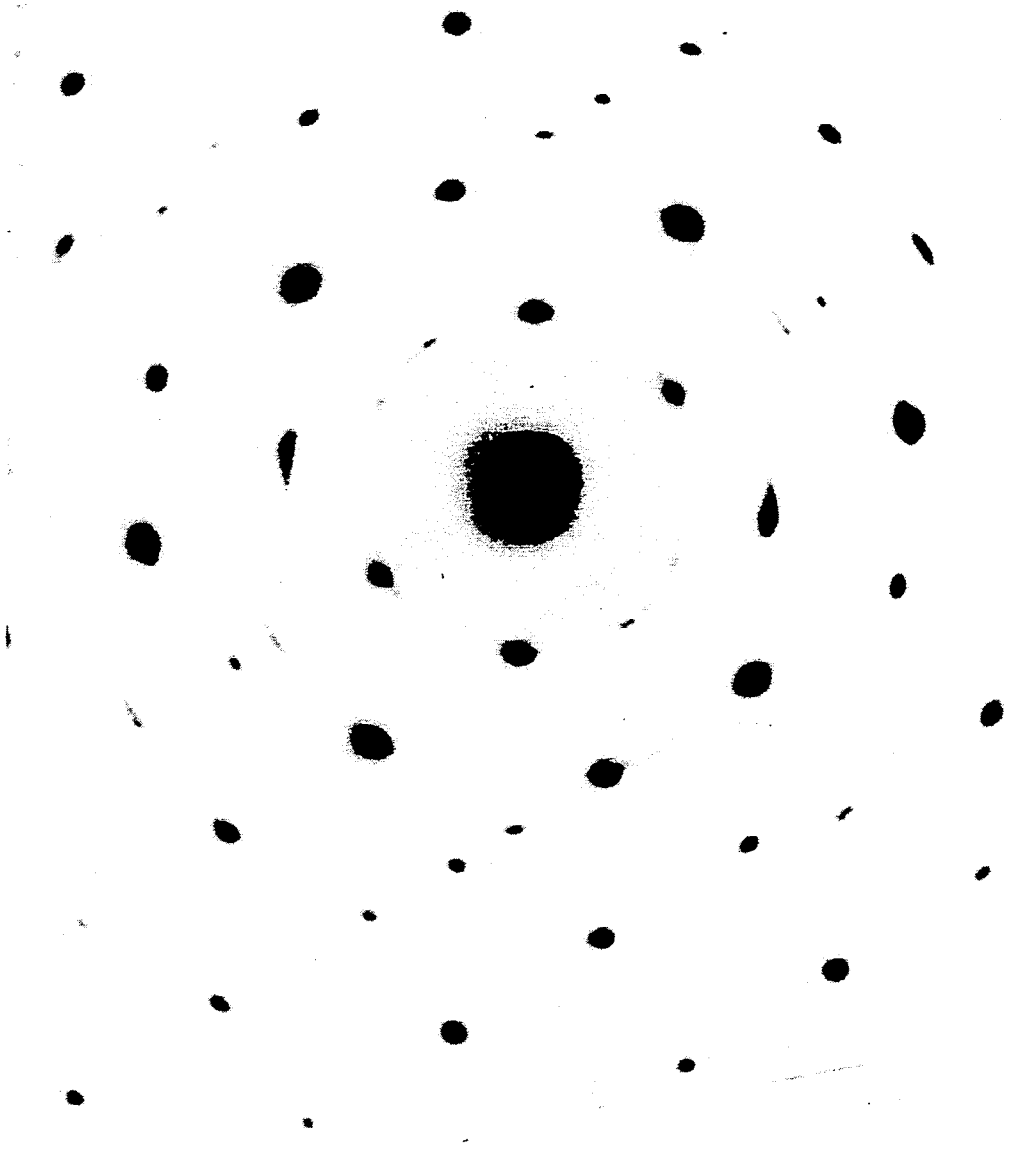
FIG. 5 is an electron diffraction pattern of 0.38 mm tantalum sheet doped with silicon plus yttrium oxide after annealing at 1500° C.

As illustrated in FIGS. 4 and 5, the disabilities associated with increased lattice strain encountered are due to the presence of yttrium oxide . The diffraction patterns of lattices indicate a significant difference between the effects of oxide and nitride additions as dopants. It appears that straining of the lattice associated with oxides is substantially more than with nitrides. Although the present invention should not be so limited, one theory accounting for the strained lattice is that the higher thermodynamic stability of oxides could prevent the interaction between oxides and the matrix and hence the straining of matrix. The higher stability may also prevent the dissolution of oxide particles into matrix. With the prolonged exposure to elevated temperatures (as encountered during processing and application procedures), oxide particles might grow via mechanisms akin to Ostwald ripening; thereby resulting in grain-growth. The size of precipitates for sheet metal produced in accordance with the procedures of Examples 1 and 3 and illustrated in FIG. 6, suggest elevated grain-growth where yttrium oxide and silicon were used. The formation of yttrium silicide leads to an alloy which includes the characteristics of improved ductility, a high degree of processability, and improved microstructure stability which resists grain growth after exposure to temperatures of greater than about 1500° C.

Applicant's have unexpectedly discovered improved ductility in a product formed from tantalum powder doped with a material having lower Gibbs value (absolute) than yttrium oxide.

As illustrated in Table 5 below, x-ray diffraction analysis of compositions produced by the procedures of Examples 1 and 3 shows that the blend containing the composition of yttrium nitride and silicon indicated the presence of yttrium silicide, dispersed in the base metal matrix while the yttrium oxide and silicon blend did not. Although, the latter did have yttrium silicate, the thermodynamic stability of yttrium oxide apparently prohibits its decomposition. It is believed that yttrium oxide preempts the formation of yttrium silicide. Silicide cannot be formed, and an oxide (yttrium silicate) is formed instead. The stability of the silicate is expected to be similar or higher than that of yttrium oxide. Similarly, the silicates effectiveness as a dispersoid will have limitations similar to those of yttrium oxide. The formation of yttrium silicide therefore is unexpected due to the potential for oxidation of yttrium nitride into the more stable form of yttrium oxide during processing.

EXAMPLE 1

Tantalum powder was blended with silicon and yttrium nitride powders (nominal particle size <200 mesh) to obtain a nominal composition of 400 parts per million of silicon and 100 parts per million of yttrium nitride by weight with the balance tantalum powder. Blending was accomplished in about 2 minutes in a twin cone blender. The total weight of the blend was about 50 pounds. Physical and chemical properties of starting tantalum powder are given in Table 1 below.

The blended powder was cold isostatically pressed into two bars at 60,000 PSI; each bar weighed about 22 pounds. The cross-section of the bar was about 41 mm×41 mm. The bars were sintered by direct resistance sintering in a vacuum furnace at a temperature of between about 2200°-2400° C. The bars were maintained through this temperature range for about 4 hours. Sintered bars were rolled to a 20 mm×20 mm cross-section and annealed at a temperature of 1300° C. for a period of about 2 hours. The bars were then rolled to 9 mm×9 mm and reannealed at 1300° C. for an additional 2 hours. As indicated above, the bars were subsequently drawn through various dies and annealed at a temperature of about 1300° C. The final wire diameter generated for purposes of the examples of the present invention is 0.25 mm.

TABLE 1

PROPERTIES OF STARTING TANTALUM POWDER

| Chemical Analysis | |
|---|---|
| Element | Concentration (ppm) |
| C | 10 ppm |
| $O_2$ | 840 |
| $H_2$ | <5 |
| $N_2$ | <25 |
| Others | Not Detected |
| **Sieve Analysis** | |
| Size | Wt % |
| +60 Mesh | 0 |
| 60/100 Mesh | 0 |
| 100/200 Mesh | 18.8% |

TABLE 1-continued

| PROPERTIES OF STARTING TANTALUM POWDER | |
|---|---|
| 200/325 Mesh | 31.6% |
| −325 Mesh | 49.5% |

Analytical ASTM test procedures were utilized to determine the particle size (B-214), grain size (B-112), and tensile strength and elongation (E-8), of the doped tantalum base powder and products of the present invention.

EXAMPLE 2

The procedure for making a tantalum base alloy wire by doping with thoriam oxide was accomplished by the decomposition of thorium nitrate into thoriam oxide during sintering. A solution of thoriam nitrate was mixed with tantalum powder to give about 100 ppm of thoriam by weight. The total weight of the blend was about 50 pounds. The physical and chemical properties of the starting tantalum powder are presented in Table 1 above.

The blended powder was cold isostatically pressed into two bars at 60,000 psi with each bar weighing about 22 pounds. The cross-section of the bar was about 41 mm×41 mm. Bars were vacuum sintered by direct resistance sintering at temperatures of approximately 2200° to 2400° C. The bars were maintained at this temperature for about 4 hours.

Sintered bars were processed into wire by the procedure presented in Example 1.

EXAMPLE 3

Tantalum powder was blended with silicon and yttrium oxide powders (nominal particle size<200 mesh) to obtain a nominal composition of 400 parts per million of silicon and 100 parts per million of yttrium oxide by weight in predominantly tantalum powder. Blending was accomplished in about 2 minutes in a twin cone blender. The total weight of the blend was about 50 pounds. The physical and chemical properties of starting tantalum powder are presented in Table 1.

The blended powder was processed into bars and then wire by the procedure of Example 1.

EXAMPLE 4

Tantalum powder was blended with silicon powder (nominal particle size<200 mesh) to obtain a nominal composition of 400 parts per million of silicon weight in predominantly tantalum powder. Blending was accomplished in about 2 minutes in a twin cone blender. The total weight of the blend was about 50 pounds. The physical and chemical properties of starting tantalum powder are presented in Table 1.

The blended powder was processed into bars and then wire by the procedure of Example 3.

Polishing and etching of wire samples produced by the procedures of Examples 1 to 4 was performed in accordance with commercially accepted procedures known in the art.

The microstructure of wire produced by Example 1, together with those of wires from Examples 2, 3 and 4, is shown in FIG. 1. Wire doped with the combination of yttrium nitride and silicon exhibits full recrystallized yet fine particles. In contrast, wire made from tantalum doped with yttrium oxide and silicon exhibits less than full recrystallized particles. Table 2 gives the grain-size, mechanical and chemical properties of wires form Examples 1, 2, 3 and 4. High strength ductility of the wire from Example 1 are evident.

TABLE 2

| PROPERTIES OF WIRE 0.25 mm DIAMETER TANTALUM WIRES | | | | |
|---|---|---|---|---|
| Examples | 1 | 2 | 3 | 4 |
| Grain Size in micrometers | 2.8 | 6 | 2[1] | 6 |
| Mechanical Strength | | | | |
| Tensile Strength (KSI) | 87.1 | 73.4 | 90.2 | 74.1 |
| Yield Strength (KSI) | 67.7 | 54.2 | 79.9 | 53.2 |
| Elongation (%) | 24.8 | 23.8 | 20 | 24.6 |
| Chemical Composition (in ppm) | | | | |
| Si | 225 | — | 250 | 250 |
| Y | 30 | — | 40 | — |
| Th | — | 80 | — | — |
| C | 45 | 45 | 65 | 50 |
| $N_2$ | 45 | 35 | 30 | 10 |
| $O_2$ | 190 | 145 | 120 | 75 |
| Others | None | None | None | None |

[1]Not fully recrystallized (NFR)

EXAMPLE 5

Wires from Examples 1 to 4 were pressed into tantalum powder, sintered under vacuum, and tested for bend-ductility in accordance with the test procedure presented below.

Three sintering cycles were used. In the first cycle, the furnace was evacuated and the temperature was raised to 1670° C. for 30 minutes and then shut-off. The second cycle is the same as the first cycle except that the furnace was back-filled with argon after the evacuation, reevacuated, and then the temperature was raised to 1670° C. and, after 30 minutes, the furnace was shut off. The third cycle is the same as the first except that wire/-powder assemblies were reheated for 2 minutes at 1670° C.

It should be noted that all three sintering cycles simulate industrial practices and should be familiar to those skilled in the art.

Procedure for Bend Test

The bend-ductility of the sintered wire is determined by securing a sintered anode preformed with one inch wire embedded therein. A 54 gm dead weight is attached to the lead extremity. The anode is then pivoted through a 180 degree arc causing the wire to bend at the juncture with the anode. For purposes of the present invention, one bend is defined as the complete pivoting of the anode through a 90 degree arc and returning to the starting position. The number of bends are counted. Ten anodes are tested and the bend ductility is average on the basis of of ten runs.

Table 3 compares the bend-ductility of wire formed by the procedures set forth in Examples 1 to 4. The wire produced according to the procedure of Example 1) exhibits 57% improvement in comparison with tantalum wire doped with silicon and yttrium oxide after 30 minutes of sintering followed by an additional two minutes.

TABLE 3

| BEND-DUCTILITY OF 0.25 mm DIAMETER OF TANTALUM WIRE | | | | |
|---|---|---|---|---|
| Example | 1 | 2 | 3 | 4 |
| Blend | 100 YN + | 100 $ThO_2$ | 100 $Y_2O_3$ + | 400 Si |

TABLE 3-continued

| BEND-DUCTILITY OF 0.25 mm DIAMETER OF TANTALUM WIRE | | | | |
|---|---|---|---|---|
| Example | 1 | 2 | 3 | 4 |
| Compositions (in ppm) | 400 Si | | 400 Si | |
| Thermal Cycle 1670° C./30 min | 4.2 | 0.5 | 4 | 4 |
| 1670° C./30 min after purging with Argon and Re-evacuation | 3.5 | 0.1 | 2.9 | 2.2 |
| 1670° C./30 min + 2 min | 2.2 | 0.1 | 1.4 | 0.9 |

EXAMPLE 6

Composition of Examples 1, 2, 3 and 4 were also processed into 9 mm×9 mm annealed bars which were rolled into 0.38 mm thick sheets. The sheets were annealed at various temperatures to demonstrate the high temperature stability of composition of Example 1. Samples were polished and etched prior to evaluation and taking of the photomicrographs illustrated in FIG. 3. Table 4 compares the grain-sizes of sheets produced by the Examples listed.

TABLE 4

| GRAIN-SIZES OF 0.38 mm THICK TANTALUM SHEETS IN MICROMETERS | | | | |
|---|---|---|---|---|
| Example | 1 | 2 | 3 | 4 |
| Blend Composition (in ppm) | 100 YN + 400 Si | 100 $ThO_2$ | 100 $Y_2O_3$ 400 Si | 400 Si |
| Annealed at 1500° C./2 hr/Vac | 11 | 22 | 14[1] | 16 |
| Annealed at 1650° C./2 hr/Vac | 14 | 26 | 17 | 25 |
| Anneal at 1800° C./2 hr/Vac | 22 | 135 | 27 | 57 |

[1]NFR = Not Fully Recrystallized

EXAMPLE 7

Figure 6A:
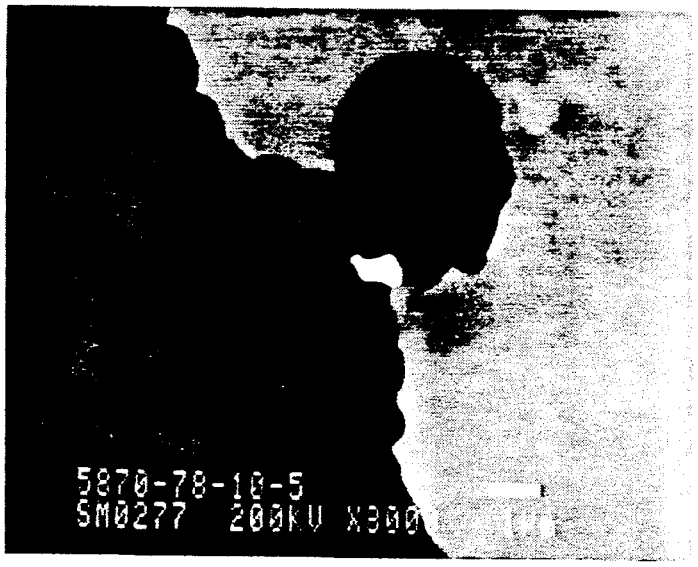
FIG. 6 is an electron photomicrograph of 0.38 mm tantalum sheet used in FIGS. 4 and 5, which illustrates the size of precipitates after annealing at 1500° C.
Figure 6B:
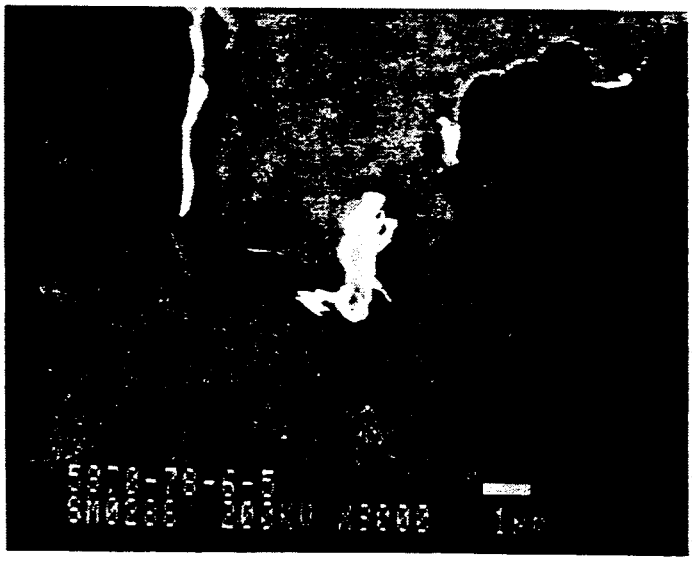

Sheets of compositions produced by the procedure of Examples 1 (400Si+100YN) and 3 (400Si+100$Y_2O_3$) were evaluated via electron microscopy after annealing at 1500° C. Discs were cut to about 250 micrometers in thickness using a slow speed diamond saw. The discs were then ion milled to a thickness of 50–100 micrometers and then electropolished in a 90% $H_2SO_4$+10% HF solution until they developed microperforations. Diffraction patterns of lattices of samples of compositions of Example 1 (400Si+100YN) and Example 3 (400Si+100$Y_2O_3$) were also taken as illustrated in FIGS. 4 and 5. The electron microscopy was performed in the vicinity of the perforations as illustrated in FIG. 6. Scanning electron micrographs in the vicinity of micro-perforations demonstrate the size of yttrium oxide precipitates in comparison with yttrium nitride. Precipitates are visible as bright areas. The size of precipitate in the sample of composition of Example 1 (400Si+100YN) is about 0.7×0.9 micrometers and the size of precipitate in the sample of composition of Example 3 (400Si+100$Y_2O_3$) is about 1.2×3 micrometers.

EXAMPLE 8

Powders of tantalum, silicon, yttrium nitride and yttrium oxide were prepared from materials made by the procedure of Examples 1 and 3 and were blended in the following proportion:

Blend-Composition

Ta+10%YN+40%Si

Ta+10%$Y_2O_3$+40%Si

The relative amounts of silicon and yttrium nitride, and yttrium oxide were similar to those used in Examples 1 and 3. Blends were heated at 1300° C. for two hours under vacuum and evaluated via x-ray diffraction. As illustrated in Table 5 below, the blend containing the composition of yttrium nitride and silicon showed the presence of yttrium silicide, while the yttrium oxide and silicon blend did not.

TABLE 5

| Identification of Yttrium Silicide and Yttrium Silicate by X-Ray Diffraction (XRD) | | | | | | | | |
|---|---|---|---|---|---|---|---|---|
| Composition Heated At | Ta + 10% YN + 40% Si 1300° C. | | | | Ti + 10% Y2 O3 + 4% Si 1300° C. | | | |
| | XRD Of Sample | | Known Pattern for Y Si2 | | XRD of Sample | | Known Pattern For Y2 SiO5 | |
| | din A | I | din A | I | din A | I | din A | I |
| | | | | | 6.11 | 1 | 6.11 | 0.77 |
| | 4.1315 | 14 | 4.13 | 18 | 5.89 | 1 | 5.89 | 1.5 |
| | 3.496 | 100 | 3.5 | 88 | 3.891 | 3 | 3.90 | 6.9 |
| | 2.568 | 46 | 2.57 | 53 | 3.66 | 1 | 3.66 | 0.46 |
| | 2.386 | 15 | 2.389 | 16 | 3.504 | 100 | 3.55 | 6.2 |
| | 2.243 | 85 | 2.246 | 84 | 3.324 | 2 | 3.36 | 0.46 |
| | 2.186 | 16 | 2.187 | 26 | 3.132 | 62 | 3.14 | 7.3 |
| | 2.068 | 39 | 2.07 | 31 | 3.022 | 6 | 3.03 | 7.3 |
| | 1.931 | 63 | 1.932 | 57 | 2.94 | 2 | 2.945 | 5.4 |
| | 1.613 | 7 | 1.615 | 8.8 | 2.907 | 5 | 2.906 | 7.7 |
| | 1.564 | 6 | 1.565 | 5.3 | 2.806 | 1 | 2.806 | 0.46 |
| | 1.522 | 26 | 1.525 | 18 | 2.648 | 2 | 2.671 | 0.77 |
| | 1.503 | 25 | 1.505 | 22 | 2.592 | 10 | 2.599 | 0.46 |
| | 1.411 | 17 | 1.413 | 16 | 2.571 | 57 | 2.55 | 4.6 |
| | 1.379 | 4 | 1.38 | 3.5 | 2.429 | 5 | 2.43 | 1.9 |
| | 1.351 | 34 | 1.353 | 18 | 2.246 | 84 | 2.249 | 0.77 |
| | 1.272 | 18 | 1.273 | 16 | 2.188 | 29 | 2.203 | 2.7 |
| | 1.252 | 7 | 1.252 | 5.3 | 2.032 | 1 | 2.032 | 0.46 |
| | | | | | 1.987 | 1 | 1.987 | 0.46 |
| | | | | | 1.852 | 1 | 1.852 | 0.62 |

TABLE 5-continued

| Composition Heated At | Identification of Yttrium Silicide and Yttrium Silicate by X-Ray Diffraction (XRD) | | | | | | | |
|---|---|---|---|---|---|---|---|---|
| | Ta + 10% YN + 40% Si 1300° C. | | | | Ti + 10% Y2 O3 + 4% Si 1300° C. | | | |
| | XRD Of Sample | | Known Pattern for Y Si2 | | XRD of Sample | | Known Pattern For Y2 SiO5 | |
| | din A | I | din A | I | din A | I | din A | I |
| | | | | | 1.523 | 29 | 1.517 | 1.2 |

EXAMPLE 10

Bars having a diameter of 6 mm and having the compositions listed in Table 6 were produced according to the procedure of Example 1. Annealed bars at intermediate stage of 9 mm×9 mm were drawn through various dies ending up with 6 mm diameter. Bars were annealed at 1300° C. and tested for mechanical properties. The synergistic effects of yttrium nitride and silicon on the mechanical properties of the bars is evident from the data presented below.

TABLE 6

| PROPERTIES OF 6 mm DIAMETER TANTALUM BARS | | | | | |
|---|---|---|---|---|---|
| Blend Composition (in ppm) Annealed at 1300° C./2 hr/vac | No Additive (pure Ta) | 400 Si | 100 YN | 400 Si 100 YN | 400 Si 500 YN |
| Y.S. (in KSI) | 36.7 | 39.6 | 40.2 | 53.7 | 52.9 |
| T.S. (in KSI) | 53.8 | 58.3 | 58.2 | 73.4 | 72.1 |
| Hardness (DPH) | 110 | 118 | 114 | 130 | 130 |

Those of ordinary skill in the art will recognize that many changes and modifications can be made in the above description without departing from the spirit of the invention.

We claim:

1. A wrought metal alloy product comprising, a tantalum or niobium base metal, a quantity of silicon between about 10 to about 1000 ppm, a quantity between about 10 to about 1000 ppm of a dopant comprising a metallic and a non-metallic component, said dopant having a free energy of formation greater than compounds formed from said base metal and said non-metallic component and less than oxides of said metallic component.

2. The wrought metal alloy product of claim 1 wherein said non-metallic component is selected from the group consisting of nitrogen, sulfur, selenium, tellurium, arsenic, antimony, carbon, phosphorous, and boron.

3. The wrought metal alloy product of claim 1 wherein said dopant is yttrium nitride.

4. The wrought metal alloy of claim 1 wherein said alloy maintains a fine uniform grain size after exposure to elevated temperatures of greater than 1300° C.

5. The wrought metal alloy product of claim 1 wherein said product has a ductility of about 20% after exposure to elevated temperatures of greater than 1300° C.

6. The wrought metal alloy product of claim 1 wherein said product comprises a silicide of said metallic component of said dopant dispersed in a base metal matrix.

7. The wrought metal alloy product of claim 4 wherein said fine grain size is from about 2 to about 30 microns.

8. The metal alloy product of claim 7 wherein said product has a bend-ductility of about 4 after exposure to temperature of greater than 1500° C.

9. A wrought metal alloy product comprising a tantalum or niobium base metal, said base metal doped with a quantity of silicon ranging from about 10 ppm to about 1000 ppm and a quantity of yttrium nitride ranging from about 10 to about 1000 ppm.

10. The wrought metal alloy product of claim 9 wherein said alloy maintains a fine uniform grain size after exposure to elevated temperatures of greater than 1300° C.

11. The wrought metal alloy product of claim 10 wherein said fine grain size is from about 2 to about 30 microns.

12. The wrought metal alloy product of claim 10 wherein said product has a ductility of about 20% after exposure to elevated temperatures of greater than 1300° C.

13. The wrought metal alloy product of claim 12 wherein said product comprises yttrium silicide dispersed in a base metal matrix.

14. The metal alloy product of claim 12 wherein said product has a bend-ductility of about 4 after exposure to temperature of greater than 1500° C.

15. In a wrought metal alloy product, the combination of tantalum or niobium metal with about 10 to about 1000 ppm silicon, and about 10 to about 1000 ppm yttrium nitride, said metal alloy having a fine grain size of about 2 microns to about 30 microns.

16. The wrought metal alloy product of claim 15 wherein said product has a ductility of about 20% after exposure to elevated temperatures of greater than 1300° C.

17. The metal alloy product of claim 15 wherein said product has a bend-ductility of about 4 after exposure to temperature of greater than 1500° C.

18. The wrought metal alloy product of claim 17 wherein said product comprises yttrium silicide dispersed in a base metal matrix.

19. The wrought metal alloy product of claim 18 wherein said tantalum base metal has a level of impurities of less than 50 ppm carbon and less than 300 ppm $O_2$.

20. In a wrought metal alloy product, the combination of tantalum or niobium metal with about 100 to about 500 ppm silicon and about 100 to about 500 ppm yttrium nitride, said metal alloy having a fine uniform grain size of about 2 microns to about 30 microns after exposure to elevated temperatures.

21. The wrought metal alloy product of claim 20 wherein said product has a ductility of about 20% after exposure to elevated temperatures of greater than 1300° C.

22. In a metal alloy wire, the combination of tantalum base metal with about 100 to about 400 ppm silicon and about 100 to about 400 ppm yttrium nitride, said tantalum base metal having a level of impurities of less than 50 ppm carbon and less than 300 ppm $O_2$.

23. The metal alloy wire of claim 22 wherein said wire maintains a fine uniform grain size after exposure to elevated temperatures of greater than 1300° C.

24. The metal alloy wire of claim 23 wherein said fine grain size is from about 2 to about 30 microns.

25. The metal alloy wire of claim 24 wherein said wire has a ductility of about 20% after exposure to elevated temperatures of greater than 1300° C.

26. The metal alloy wire of claim 25 wherein said product comprises yttrium silicide dispersed in a base metal matrix.

27. The metal alloy wire of claim 26 wherein said wire has a bend-ductility of about 4 after exposure to temperature of greater than 1500° C.

* * * * *